US006453948B2

(12) United States Patent
Notz et al.

(10) Patent No.: US 6,453,948 B2
(45) Date of Patent: Sep. 24, 2002

(54) VALVE ARRANGEMENT

(75) Inventors: Frank Notz, Dettingen; Thomas Müller, Filderstadt, both of (DE)

(73) Assignee: Festo AG & Co., Esslingen (DE)

( * ) Notice: Subject to any disclaimer, the term of this patent is extended or adjusted under 35 U.S.C. 154(b) by 0 days.

(21) Appl. No.: 09/753,846

(22) Filed: Jan. 3, 2001

(30) Foreign Application Priority Data

Jan. 25, 2000 (EP) ..... 00101394

(51) Int. Cl.[7] ..... F15B 13/08
(52) U.S. Cl. ..... 137/884; 137/382
(58) Field of Search ..... 137/884, 377, 137/382

(56) References Cited

U.S. PATENT DOCUMENTS

| | | | | | |
|---|---|---|---|---|---|
| 3,111,139 | A | * | 11/1963 | Beckett et al. | 137/884 |
| 3,559,687 | A | * | 2/1971 | Aslan | 137/625.69 |
| 3,957,079 | A | | 5/1976 | Whiteman | |
| 4,515,184 | A | * | 5/1985 | Bownass et al. | 137/625.66 |
| 4,785,848 | A | | 11/1988 | Leiber | |
| 4,830,054 | A | | 5/1989 | Feichtiger et al. | |
| 4,898,360 | A | | 2/1990 | VonHayn et al. | |
| 5,184,648 | A | * | 2/1993 | Walter et al. | 137/884 |
| 5,195,720 | A | * | 3/1993 | Nortier et al. | 251/129.04 |
| 5,236,017 | A | | 8/1993 | Meyer et al. | |
| 5,692,813 | A | * | 12/1997 | Vellmer | 303/119.2 |
| 5,700,071 | A | | 12/1997 | Steffes et al. | |
| 5,915,666 | A | * | 6/1999 | Hayashi et al. | 137/884 |
| 5,996,629 | A | * | 12/1999 | Sato et al. | 137/625.64 |
| 6,062,254 | A | * | 5/2000 | Brady et al. | 137/382 |

FOREIGN PATENT DOCUMENTS

| | | | | |
|---|---|---|---|---|
| DE | 2408768 | * | 9/1975 | 137/884 |
| DE | 37 29 550 A1 | | 3/1989 | |
| DE | 195 19 888 A1 | | 12/1996 | |
| EP | 0 864 762 A1 | | 9/1998 | |

* cited by examiner

*Primary Examiner*—John Fox
(74) *Attorney, Agent, or Firm*—Hoffmann & Baron, LLP

(57) ABSTRACT

A valve comprising a valve carrier on which a plurality of control units are mounted adjacent to one another. Each control unit possesses a liquid-tight casing body in which the component of a valve unit are received and is mounted on the valve carrier with a seal in between. It is in this manner that a liquid-tight, encapsulated and individual accommodation of the singular valve units is ensured.

23 Claims, 3 Drawing Sheets

VALVE ARRANGEMENT

BACKGROUND OF THE INVENTION

The invention relates to a valve arrangement comprising a valve carrier, on which a plurality of control units are mounted with a mounting side to the fore and alongside each other, such control units each having a valve unit with a valve communicating in a sealing manner with fluid ducts in the valve carrier and furthermore having at least one electrically operated valve drive serving for the actuation of the valve.

THE PRIOR ART

A valve arrangement of this type is disclosed for instance in the European patent publication 0 608 245 B1. This known valve arrangement is provided with a plate-like valve carrier, which on a component mounting side is provided bearing a plurality of adjacently placed control units. The control units are constituted by valve units, each respectively comprising a valve and an electrically operated valve drive. The valves communicate with fluids ducts extending in the valve carrier and are in the position of supplying connected loads with pressure medium in a manner dependent on the controlled operation of the valve drives.

If such known valve arrangement is employed in the foodstuff and/or medical industry sector, particular problems arise as regards cleaning external surfaces of the valve arrangement. For reasons of hygiene extreme cleanliness must be observed here, but difficulties however arise because liquids and also solid materials collecting in the crevices and interstices present can hardly be dealt with. As a rule liquid cleaning devices such as high pressure cleaners are utilized to attempt to wash out the dirt. However in this case there is the problem that aggressive cleaning agents also penetrate into the interior of the valve unit, where they may cause damage. Furthermore corrosion damage or contamination of the foodstuffs may occur in connection with any residues of cleaning materials not removed.

SHORT SUMMARY OF THE INVENTION

One object of the invention is to create a valve arrangement of the type originally mentioned particularly suitable for environments involving intensive use of cleaning materials.

In order to achieve these and/or other objects appearing from the present specification, claims and drawings, in the present invention the control units each comprise a liquid-tight casing body in which the components of the associated valve unit are jointly accommodated and which is mounted at the mounting side in a sealing manner on the valve body so that a liquid-tight, encapsulated individual accommodation of the individual valve units is provided.

The result is thus a valve arrangement also suitable for use in environments involving intensive application of cleaning materials, that is to say more especially for applications in the foodstuff, medical and semiconductor sectors. Due to the liquid-tight encapsulation of the valve units effective steps are taken to see that with application of sprayed cleaning liquid under high pressure same does not come into contact with the valve unit and cause damage thereto. Because the casing body may be produced with a smooth surface, it can be readily cleaned and consequently offers no or hardly any point on which dirt or residues could collect. Because the valve units furthermore constitute individual control units, it is moreover possible to ensure that a single valve unit may be individually replaced if it should become defective without interfering with the remaining control units. In this respect one particular embodiment is more especially advantageous, in the case of which the control units constitute self-contained and coherent assembly units, which are able to be handled bodily, i.e. so that the valve units and the casing body and accordingly together with the attachment of the casing body can be handled and also the attachment of the casing body and the attachment of the associated valve unit takes place simultaneously, something which considerably facilitates handling.

Further advantageous forms of the valve arrangement in accordance with the invention will appear from the claims.

The casing bodies of the control units may for instance consist of a corrosion resistant metal and more particularly stainless steel. As regards the material and manufacture a particular structure has price advantages, whose casing body includes a plastic material, as for instance polypropylene material. This renders possible a rational manufacture as plastic molding in some other plastic manufacturing and shaping system.

In order to prevent dirt collecting and at the same time to ensure a reliable cleaning operation it is more particularly preferred to make the outer face of the casing body without any edges and to shape rounded features and any transitions between flat surface sections with radiuses of at least three millimeters. The structure is thus intentionally made without a sharp edges on which residues of the cleaning material might collect after intensive cleaning.

The casing body may at least in part be made translucent so that light signals, produced by the valve unit, are visible from the outside through the translucent zone. The valve unit may for example be provided with light emitting diodes, which indicate the state of operation so that in the present case reliable monitoring from the outside is possible without openings in the casing body being necessary for this purpose. The translucent zones can be integral components of the casing body.

It is in principle possible, more particularly in the case of a design of the casing body of plastic material, to mold the casing body directly on the valve unit so that the number of the intermediate spaces between the casing body and the valve unit may be very simply reduced to a minimum. It would be feasible as well to a have a design similar to a skin directly enveloping the valve unit.

On the other hand it may be an advantage, more particularly also to ensure protection against mechanical damage, for the casing body to be made as a dimensionally stable component. In any case it is an advantage for the control unit comprising a casing body and the valve unit accommodated therein, to constitute, as already mentioned, a common structural unit handled as such, which may be uniformly assembled and taken to pieces without entailing the taking to pieces of the individual components.

To provide a sealing connection between the casing body and the valve unit a bonded or welded join may be provided. It is however more especially convenient to place a seal in between. Such seal is preferably molded on the control unit and preferably on the casing body, something which may be provided for by injection molding in an extremely simple fashion.

More particularly when the casing body is a dimensionally stable structure, intermediate spaces may be present between the casing body and the valve unit. Furthermore such intermediate spaces can normally not be avoided between the individual components of the valve unit. In such a case it may be an advantage for such intermediate spaces in the interior of the casing body to be at least partially and preferably completely filled with a filling material. It is in this manner that great variations in temperature, which are due to the application of the valve, may take place without water condensing, which would impair operation. The filling composition is preferably placed in the cavities by a injection molding operation or by foaming.

The filling composition may if required also perform an attachment function and serve to secure the valve unit in the interior of the casing body. Here the filling composition may constitute the sole attachment means so that no further attachment means, such as screws, are necessary to ensure the coherence of the casing body and the valve unit.

The seal acting between a control unit and the valve carrier is preferably an integral component of the filling composition so that the filling of the cavities may be performed like molding the seal as part of a common manufacturing process. All in all a twin component molding method is suitable, in which firstly the casing body is molded using a first plastic material into which in a further molding step, with the valve unit already integrated, the filling composition is introduced and simultaneously the seal is formed. This may take place in two separate injection molding devices or in a common injection molding device. It is possible firstly to mold the casing body and then to insert the valve unit and finally to inject the molding composition. It would however also be feasible to place the valve unit as an inserted part in an injection molding mold and to inject the casing body around same, the body then being completed with the seal and if necessary with the filling composition.

As a filling composition a rubber material or an elastomeric material may be employed.

The casing body is preferably in the form of a hoodlike body, which is slipped over the valve unit and with its opening to the fore is mounted on the valve carrier.

Again for reasons of ease of cleaning it is an advantage for the outer surface of the casing bony to be so designed that the surface roughness is at the most 2.24 microns. This is normally in accordance with the German standard VDI-Richtlinie 3400 Class 27–30.

In order to ensure that the cleaning material can readily drain off and that dirt does not collect, the control units are preferably arranged with a spacing between them on the valve carrier, it being recommended to have a spacing apart of at least five millimeters.

The valve carrier will as a rule have fluid ducts opening through at least one end face, where they may be connected with fluid pipes serving for the supply and/or removal of the pressure medium, particularly compressed air. It is an advantage here for a smooth-surfaced terminating body to be mounted with a sealing effect on the respective end and in which bypass ducts are located which at one end communicate with the fluid ducts and at the other end communicate with a connection face, at which fluid ducts leading to other equipment may be connected and which is placed opposite to the mounting face of the valve carrier carrying the control units.

The outer face of the terminating body is preferably made without any edges and designed to enable optimum cleaning by having the transitions between any flat surface sections and the rounded surface sections made with a radius of at least one millimeter.

In order to ensure that the liquid cleaning material is able to freely drain away it is furthermore an advantage if the overall height of the individual casing bodies is reduced from one end to the other, a continuous it reduction in height being recommended so that there is a configuration which slopes down from one end to the other.

Further advantageous developments and convenient forms of the invention will be understood from the following detailed descriptive disclosure of one embodiment thereof in conjunction with the accompanying drawings.

LIST OF THE SEVERAL VIEWS OF THE FIGURES

DETAILED ACCOUNT OF WORKING EMBODIMENT OF THE INVENTION.

The valve arrangement of the working example generally referenced 1 comprises a plate-like valve carrier 2, which in the present case is made integral, but however could be modular and made up of a plurality of fixedly arranged valve carrier elements in a row.

Figure 2:
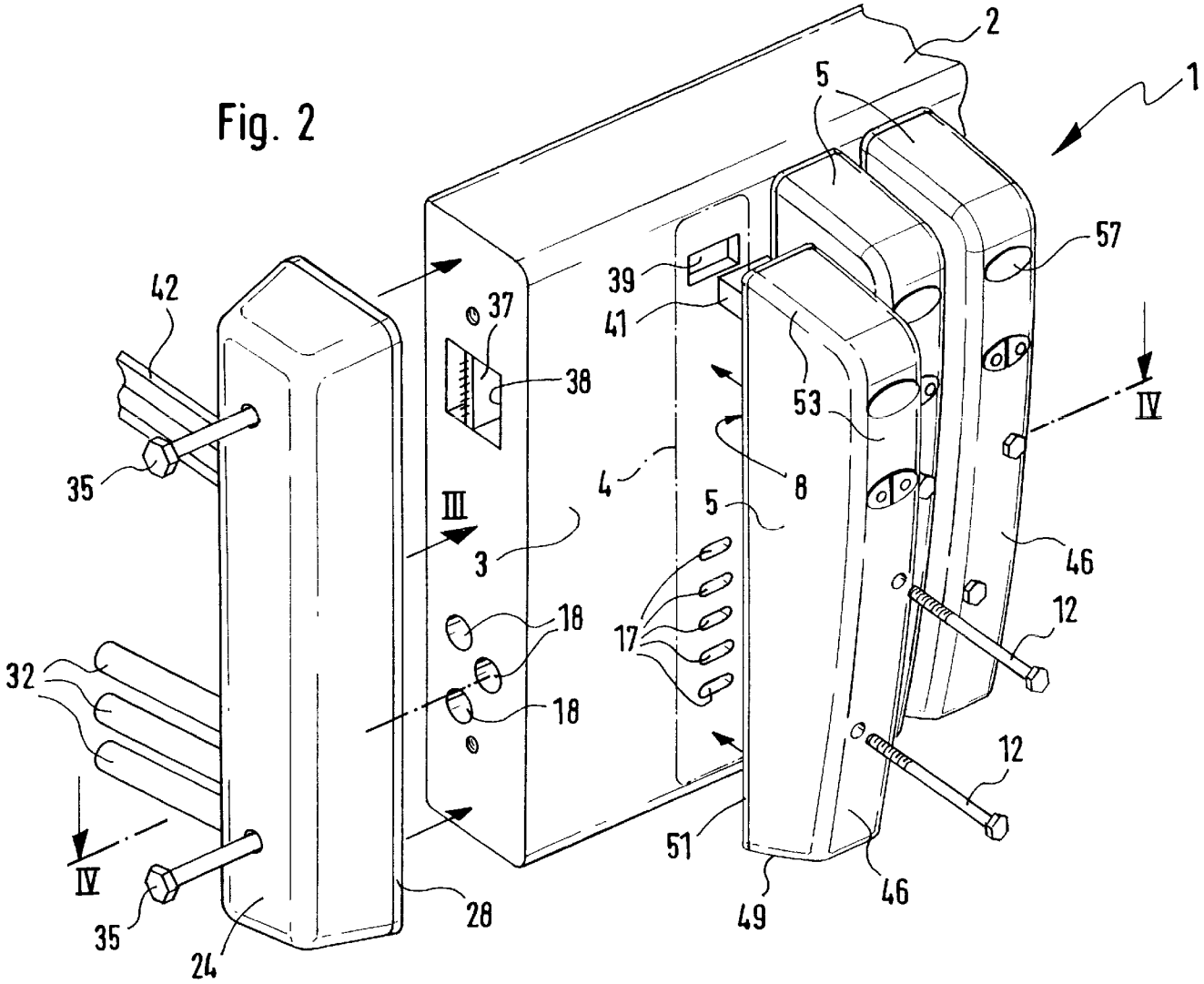
FIG. 2 shows the valve unit of FIG. 1 with a vertical alignment of the valve carrier, partly in an exploded view.

One of the two major faces of the valve carrier 2 constitutes a mounting side 3, on which a plurality of mounting areas 4 are provided, of which one is indicated in FIG. 2 in chained lines.

The valve carrier 2 is on its mounting side 3 provided with a plurality of valve control units 5. Same are arranged in a row one after the other, the direction 6 of the row, indicated by double arrow in FIG. 1 being at a right angle to the longitudinal axis 7 of the individual control units 5. The latter are consequently arranged alongside each other.

Each control unit 5 is preferably mounted detachably, its mounting side to the fore, on one of the mounting areas 4. Suitable attachment means 12, in the present case in the form of securing screws, ensure a firm and simultaneously releasable connection between each control unit 5 and the valve carrier 2. It is therefore possible to mount and detach the individual control units 5 independently from each other.

Figure 1:
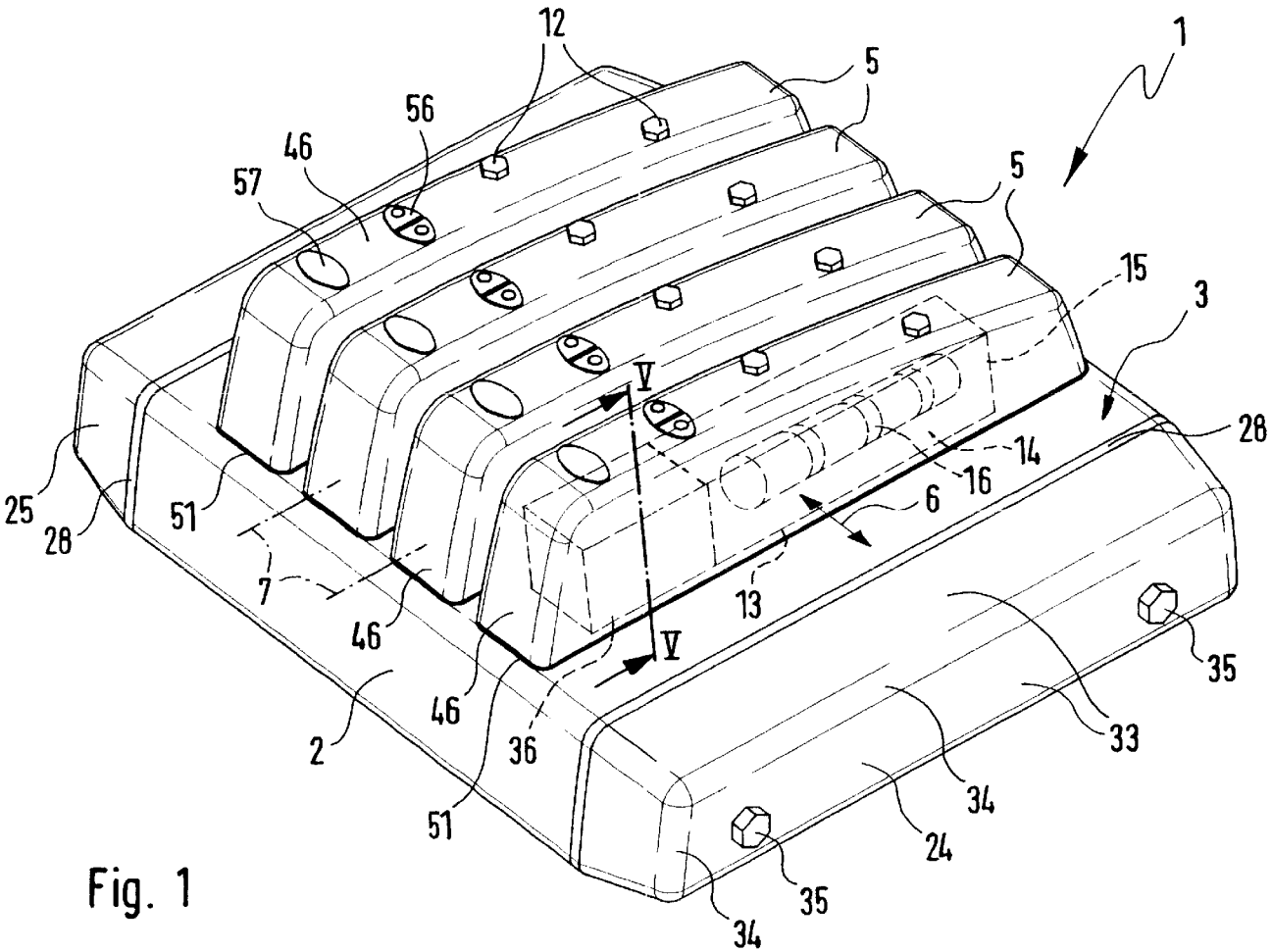
FIG. 1 shows a preferred embodiment of the valve arrangement in accordance with the invention in perspective elevation, the integrated valve unit being indicated with reference to a control unit illustrated in chained lines.
Figure 5:
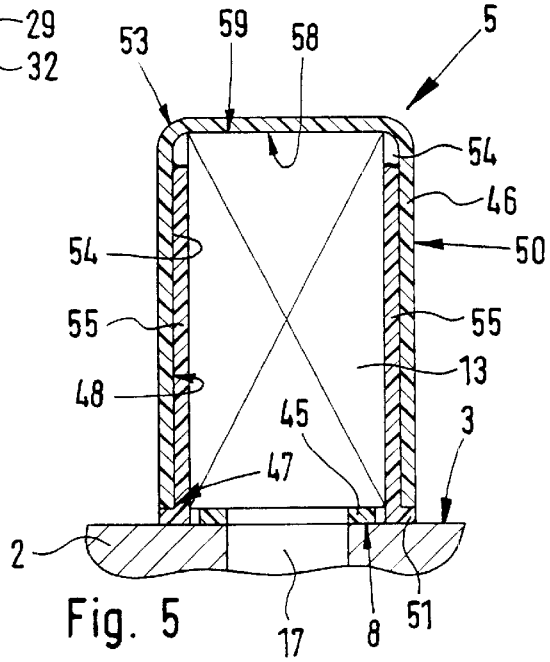
FIG. 5 is a partial cross section taken through the arrangement of FIG. 1 on the line V—V.

Each control unit 5 comprises a valve unit 13 which is indicated in FIG. 1 in chained lines and in FIG. 5 by intersecting lines. The valve unit is made up of a plurality of components and inter alia includes a valve 14 in the form of a multi-way valve having an elongated valve housing 15 and a valve member 16 mounted movingly therein.

The valve 14 possesses a plurality of valve ducts opening at the mounting side 8, such ducts not being indicated in the drawing in detail and being connected, when the control unit is mounted in place, with valve carrier ducts 17, which open at each mounting area 4. Dependent on the instantaneous setting of the valve member 16 it is possible for different fluid connections to be produced between the individual valve carrier ducts 17.

In the interior of the valve carrier 2 several fluid ducts 18 extend, preferably in parallelism to the direction 6 of the row, and which open at opposite end faces 22 of the valve carrier. They serve to supply and remove pressure medium, compressed air being supplied in the present case by way of one of the fluid ducts, whereas the two other ducts serve for venting. Each of such fluid ducts 18 is in communication with one of the valve carrier ducts 17 of a respective mounting area 4.

The two remaining valve carrier ducts 17 run athwart the valve carrier and through it and open at the rear face 23, which is opposite to the mounting side 3, of the valve carrier 2. They serve to transmit the pressure medium to and from a load, not illustrated, for example a fluid power cylinder and may open at one lateral face. The connection with this load may be produced by way of fluid ducts 24 able to be set on the rear face 23.

The connected loads may therefore be operated using the valves by fluid.

Figure 4:
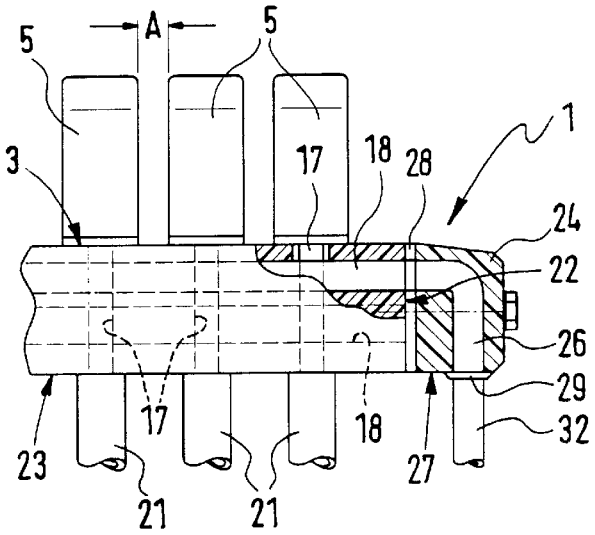
FIG. 4 is a partial longitudinal section taken through the arrangement of FIG. 2 on the line IV—IV.

On the two end faces 22 of the valve carrier 2 a terminating body 24 and 25 is respectively mounted with a sealing effect. The one, first terminating body 24 will be seen from FIG. 4 to possess integrated bypass ducts 26, which at one end open at the outer face facing the end face 22 and at the other end open at a terminating face 27. At the end face 22 they are connected with the fluid ducts 18 with the required coordination, intermediately placed sealing means 28 ensuring a transition without any leakage to the outside. Attachment means 29 are provided at the opening on the connection face 27, such means 29 rendering possible the joining up of fluid ducts 32 leading to other equipment. One of the fluid ducts can lead to a source of pressure medium and by way of at least one other fluid duct spent air may be discharged to a some point remote from the position of use of the valve arrangement.

The connection face 27 is aligned oppositely with reference to the face 3 and is directed in the same direction as the rear face 23 of the valve carrier 2.

This means that all fluid duct connections are located on the side of the valve arrangement opposite to the mounting side 3.

The second terminating body 25 associated with the other end face has, in the present working example, only a terminating function as regards the fluid ducts 18 opening here. However, it could also be provided with internal flow ducts comparable to the bypass ducts 26 in order to be able to supply and let off pressure medium selectively.

In order to create the right environment for thoroughly cleaning the outer face of the terminating bodies 24 and 25 is designed without any edges, the transitions 34 present between the flat face sections 33 and the rounded face sections present being radiused with radiuses of at least one millimeter.

For the attachment of the terminating bodies 24 and 25 on the valve carrier 2 suitable attachment means 35 are employed, in the case of which here it is a question of attachment screws, which preferably have a hex head.

The mode of operation of each individual valve 14 is set by an electrically operated valve drive 36, same constituting a further control of the respective valve unit 13. It is preferably fixedly joined with the valve 14 and may for example have a piezoelectric or electromagnetic drive means. It can be designed in the form of a direct drive or in the form of a pilot valve, the latter applying for the working example. It is pointed out that the valve units 13 may respectively comprise a plurality of valve drives 36, and more particularly two thereof, which furthermore may be collected together as an assembly.

The valve drive 36 receives its electrical operating signals by way of transmission means 37, which are accommodated in a channel extending in the valve carrier 2 in parallelism to the direction 6 of the row and may be included, via duct branches 39 which open at the respective mounting area 4, in an electrical plug connector with the respective valve drive 36. Suitable plug connecting means 41 will be seen in FIG. 2 showing the control unit 5 taken to pieces. The transmission means 37 may be in the form of means with printed circuit boards.

The electrical transmission means 37 may be connected through the associated first connection body 24 with outgoing signal lines 42, via which an electrical connection may be produced with an electronic control means. Such a means may furthermore be provided as a direct component of the valve arrangement 1, as for instance by integration in one of the two terminating bodies 24 and 25.

If a control unit 5 is mounted on a mounting area 4, the electrical connection to the valve drive 36, and the fluid power connections to the valve 14 will be automatically produced. In order to ensure that there. is an outwardly open fluid-tight transition or join between the valve 14 and the valve carrier 2 at the valve carrier ducts 17, between these two components suitable sealing means 35 are provided, same being best borne by the signal unit 5 and surrounding the openings of the valve carrier ducts 17 on the mounting area to provide a mutual sealing effect.

In addition to the valve unit 13 each control unit 5 has a liquid-tight casing body 46, which as illustrated preferably possesses a hood-like configuration with an opening 47, facing the mounting area 3, on the assembly side 8. The valve unit 13 of any respective control unit 5 is seated together complete with all its components in the interior of the filling body 46, assembly being performed by introducing the valve unit 13 through the opening 47 into the interior 48 of the casing body 46.

A seal 51 is placed in the vicinity of opening 47 between the surrounding edge of the casing body 46 and the valve carrier 2, such seal serving to ensure a fluid-tight join between the casing body 46 and the valve carrier 32, something which results in a liquid-tight encapsulated and individual accommodation of the individual valve units 13.

In lieu of a separate seal 51 it would also be possible to adopt other measures to ensure a liquid-tight connection between the casing body 46 and the valve carrier 2. It would be possible for instance to have an adhesive or a weld such as an ultrasonic weld.

The external face of the casing body 46 is preferably designed without any edges and all in all with a smooth surface so that no cracks or other cavities are present in which dirt could collect. The configuration is so selected that the transitions 49 between the flat surface sections 50 present and all other rounded surface sections 53 have radiuses of at least three millimeters. Furthermore importance is attached to having high quality surfaces, the roughness of the outer surface of the casing body 46 being 2.24 microns at the maximum, this being in accordance with the German standard VDI-Richtlinie 3400 Class 27–30.

Figure 3:
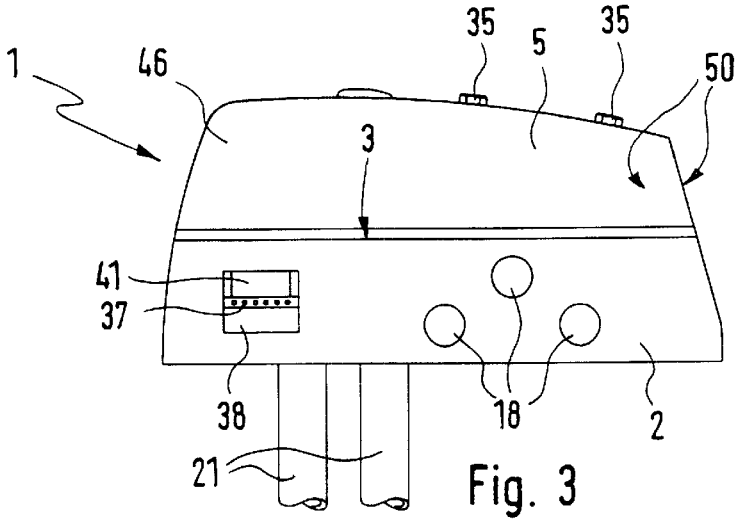
FIG. 3 shows an end-on view of the valve arrangement of FIG. 2 after removal of the end terminating body and looking in the direction of the arrow III.

To permit the cleaning liquid to drain away during cleaning at least in the case of the control units 5, but preferably also in the case of the entire valve arrangement 1, the face turned upward in use are so designed that there are no horizontal flat surface areas. Thus there may more particularly be a provision such that the casing body is designed with an overall height which is reduced from the one to the other end thereof, more particularly continuously, so that there is a top side which slopes downward as illustrated in FIG. 3.

Because furthermore the distance "A" between immediately adjacent control units 5 is made relatively large (it is best to have a size of at least one five millimeters for the distance) there is good access of the mutually facing side faces of the casing body 46 for cleaning and it is possible to avoid having deposits which are difficult to remove.

In principle it would be possible to manufacture the casing body 46 of a corrosion resistant metal and preferably of stainless steel. More particularly for reasons of price and of more adaptable design, manufacture of plastic material, more especially polypropylene material, is however to be recommended. In the working example the casing bodies 46 are manufactured as plastic components with inherent dimensional stability, which provides for reliable protection of the valve units 13 against damage.

In the working embodiment the casing bodies 46 are manufactured by injection molding. During further manufacturing operations on the control units 5 the completely assembled valve unit 13 is inserted in the finished casing body 46. In this case it is impossible to avoid certain cavities 54 being left in the interior space 48 between the inner face of the casing body 46 and the outer face in the valve unit 13. A filling composition 55 is introduced into these intermediate space 54 later through the opening 47. The introduction of the composition is performed using gage pressure while the material, which can be a plastic material, is in a pasty or liquid state. After curing of the composition—dependent on the material a certain degree of elasticity may still be present—the intermediate spaces 54 are at least partially and preferably completely filled with the filling composition 55 so that no or only a few air-filled intermediate space are left. The filling composition 55 can also penetrate into cracks, crevices or other intermediate spaces which may be present between assembled adjacent component of the valve unit 13.

By the injection of the filling composition 55 into the intermediate spaces 54 at a sufficiently high pressure an optimum degree of filling may be ensured.

The filling composition, as for example an elastomeric material or a rubber material, may enter into an adhesive bond with the walls delimiting the intermediate spaces 54 so that generally speaking there will be an intimate connection between the individual components, which also provides for sealing to keep out moisture. Without additional attachment means it is possible for the filling composition 55 alone and by itself to ensure coherence of the individual components of the control unit 5 so that joint handling is possible as if it were only a question of a single component.

The seal 51 placed at the opening 47 is preferably molded on the associated edge part of the filling body 46, more especially by injection molding. Here the working a embodiment does offer the advantage that the seal 51 is designed in the form of an integral component of the filling composition 55 and thus a section, which is outside the casing body 56, of the filling composition 55 constitutes the said seal 51. This jointly renders possible filling of the intermediate spaces 54 by injection and the formation of the seal 51 in a single working step. If needed sealing means 45 provided at the valve carrier ducts 17 may also be molded, an integral design as a part of the filling composition 55 being possible.

In the case of an embodiment, which is not illustrated in detail, the casing body 46 is directly injection molded on the outer face of the valve unit 13. Because the liquid plastic material in this case can penetrate into the intermediate spaces present between the components of the valve unit 13, it is not in such a case generally necessary here to additionally inject material or to cause foaming. The seal 51, possibly jointly with the sealing means 45, may here be molded in a further injection molding step as the second component on the assembly side 8.

It will be more particularly seen from FIGS. 1 and 2 that additional operating means 56 may be integrated in the wall of the casing body 46, which when needed render possible manual valve operation (auxiliary hand actuation).

Furthermore the casing bodies 46 in the working example have at least one preferably adjacent translucent region 57, which is arranged in the vicinity of signal means of the integrated valve unit 13, which means can emit light signals and are located in the interior 48 of the casing body 46. Here it may for example be a question of signals which indicate the state of operation of the valve 14 or a trouble condition. The translucent region 57 may be an integral component of the wall of the casing body 46 or is constituted by an additional body having corresponding properties, which is secured in an opening in the casing body 46.

The attachment means 12 serving for attachment of the control unit 5 on the valve carrier 2 are preferably so designed that on the one hand they engage the casing body 46 and on the other hand the valve carrier 2 and (as regards the casing body 46) are able to bear against the top side of the casing body 46, said top side being directed oppositely to the mounting side 3. Attachment screws with hex heads have proved to be particularly readily cleaned.

In order to ensure a sufficient pressing action at the sealing means 45 the inner configuration of the casing body 46 should be so adapted to the outer configuration of the valve unit 13 that the top face 59 of the latter (opposite to the mounting side 8) contacts an abutment face 58 at one or more points, such face 58 being provided on the inner face of the casing body 46. If the casing body 46 is biased toward the valve carrier 2 by the attachment means 12, there will be a simultaneous biasing effect in the same direction with respect to the valve unit 13 due to at least one abutment face 58 so that at the sealing means 45 there will be a biasing action as necessary to produce the sealing action.

What is claimed is:

1. A valve arrangement comprising a valve carrier, on which a plurality of control units are mounted with a mounting side to the fore and alongside each other, such control units each having a valve unit with a valve communicating in a sealing manner with fluid ducts in the valve carrier and furthermore having at least one electrically operated valve drive serving for the actuation of the valve, wherein the control units each comprise a liquid-tight casing body in which the components of the associated valve unit are jointly accommodated and which is mounted at the mounting side in a sealing manner on the valve carrier so that a liquid-tight, encapsulated individual accommodation of the individual valve units is provided.

2. The valve arrangement as set forth in claim 1, wherein at least one casing body is composed of corrosion resistant metal.

3. The valve arrangement as set forth in claim 1, wherein at least one casing body is composed of plastic material.

4. The valve arrangement as set forth in claim 3, wherein at least one casing body is in the form of an injection molding of plastic.

5. The valve arrangement as set forth in claim 1, wherein said casing body possesses an outer face, said outer face being edgeless, transitions between any flat face sections and any rounded face sections having radiuses of at least three millimeters.

6. The valve arrangement as set forth in claim 1, comprising at least one casing body which is at least partially translucent so that light signals, which are emitted by the valve unit, are visible from the outside through translucent portions of said casing body.

7. The valve arrangement as set forth in claim 1, wherein at least one casing body is designed in the form of an inherently dimensionally stable component.

8. The valve arrangement as set forth in claim 1, wherein at least one casing body and the valve unit accommodated in same are so fixedly joined together that a component means is produced which is able to be handled as a single body.

9. The valve arrangement as set forth in claim 1, comprising a seal for producing a sealing effect between the casing body and the valve carrier.

10. The valve arrangement as set forth in claim 9, wherein said seal is molded on the control unit.

11. The valve arrangement as set forth in claim 1, wherein intermediate spaces present in an interior space of at least one casing body between same and the valve unit are at least partially filled with a filling composition.

12. The valve arrangement as set forth in claim 11, wherein the filling composition is a filling composition which has been inserted by injection or a foaming technique.

13. The valve arrangement as set forth in claim 11, wherein the filling composition serves as an attachment means for location of the valve unit in the casing body.

14. The valve arrangement as set forth in claim 11, wherein between the casing body and the valve carrier a seal is provided, which is constituted by a section of the filling composition located outside the body.

15. The valve arrangement as set forth in claim 11, wherein the filling composition is an elastomeric or rubber-like material.

16. A valve arrangement comprising:

a valve carrier having a mounting side thereon and a plurality of fluid ducts therein;

a plurality of control units mounted alongside each other on said mounting side of said valve carrier, each of said control units comprising:

a valve unit including a valve communicating in a sealing manner with at least one of said fluid ducts of said valve carrier;

an electrically operated valve drive for actuating said valve unit; and a liquid-tight casing body encapsulating said valve unit and said electrically operated valve drive, said casing body being in the form of a hood and having an opening by way of which the associated valve unit and valve drive are inserted into an interior space of the casing body, and wherein said casing body forms a liquid-tight seal against said mounting side of said valve carrier.

17. The valve arrangement as set forth in claim 16, wherein a filling composition is introduced through the opening, located on the mounting side, into the casing body in the course of manufacture of the control unit.

18. The valve arrangement as set forth in claim 1, wherein said casing body possesses an outer face having a surface roughness of at the most 2.24 microns.

19. The valve arrangement as set forth in claim 1, wherein said control units are mounted with a spacing apart on a mounting side on the valve carrier, the distance apart of adjacent control units being five millimeters at least.

20. The valve arrangement as set forth in claim 1, wherein the valve carrier possesses fluid ducts leading to at least one end face, such end face having a smooth faced connection body mounted in a sealing fashion thereon, said connection body having bypass ducts therein communicating on the one hand with the fluid duct in the valve carrier and on the other hand leading to a connection face, which is aligned opposite to the mounting side carrying said control units, of the valve carrier, where fluid ducts leading to other equipment may be connected.

21. The valve arrangement as set forth in claim 20, wherein said connection body has an outer face devoid of edges, transitions between any flat face sections and any rounded face section being radiused to at least one millimeter.

22. The valve arrangement as set forth in claim 1, wherein the overall height of at least one casing body is reduced from one axial end to the other.

23. The valve arrangement as set forth in claim 1, wherein outer faces thereof which in the position of use are at the top, of at least the control units, are essentially free of horizontal flat face sections.

* * * * *

UNITED STATES PATENT AND TRADEMARK OFFICE

CERTIFICATE OF CORRECTION

PATENT NO. : 6,453,948 B2
DATED : September 24, 2002
INVENTOR(S) : Notz et al.

It is certified that error appears in the above-identified patent and that said Letters Patent is hereby corrected as shown below:

Column 3,
Line 39, now reads "outer surface of the casing bony" should read -- outer surface of the casing body --; and Column 4,
Line 2, now reads "a continuous it reduction" should read -- a continuous reduction --.

Signed and Sealed this

Eighth Day of April, 2003

JAMES E. ROGAN
*Director of the United States Patent and Trademark Office*